United States Patent [19]

Kuehn

[11] 4,454,951

[45] Jun. 19, 1984

[54] REMOTE CONTROLLED SLACK PULLING LOG SKIDDING CARRIAGE

[75] Inventor: Scott L. Kuehn, Missoula, Mont.

[73] Assignee: Champion International Corporation, Stamford, Conn.

[21] Appl. No.: 388,886

[22] Filed: Jun. 16, 1982

[51] Int. Cl.[3] ..... B66C 21/00; B66C 11/20

[52] U.S. Cl. ..... 212/89; 212/76; 212/96; 212/106; 212/108; 254/333; 254/287; 104/173 R

[58] Field of Search ..... 254/333, 287; 212/76–123; 104/112, 114, 173, 183

[56] References Cited

U.S. PATENT DOCUMENTS

| | | | |
|---|---|---|---|
| 2,279,853 | 4/1942 | White | 254/333 |
| 3,079,008 | 2/1963 | Naud | 212/96 |
| 3,083,839 | 4/1963 | McIntyre | 212/89 |
| 3,172,544 | 3/1965 | Johnson et al. | 212/89 |
| 3,388,890 | 6/1968 | Born et al. | 254/333 |
| 3,399,868 | 9/1968 | Reischl | 254/333 |
| 3,466,013 | 9/1969 | Smith, Jr. | 254/287 |
| 4,109,799 | 8/1978 | Munn | 212/83 |
| 4,113,237 | 9/1978 | Derrwaldt | 254/333 |
| 4,164,289 | 8/1979 | Haliewicz | 212/76 |
| 4,312,456 | 1/1982 | Neshold | 212/96 |

FOREIGN PATENT DOCUMENTS

| | | | |
|---|---|---|---|
| 1144505 | 3/1969 | United Kingdom | 254/287 |

*Primary Examiner*—Trygve M. Blix
*Assistant Examiner*—R. B. Johnson
*Attorney, Agent, or Firm*—Evelyn M. Sommer

[57] ABSTRACT

A remote controlled slack pulling log skidding carriage is provided for feeding a slack drag line toward a log to be skidded. A drive sheave rotatably mounted in the carriage is operated by a hydraulic motor. The fluid to operate the hydraulic motor is stored in one or more accumulators, and a radio controlled valve starts and stops the flow of fluid to the motor. A mechanically operated hydraulic pump also is provided to recharge the accumulators during a skidding operation.

7 Claims, 5 Drawing Figures

REMOTE CONTROLLED SLACK PULLING LOG SKIDDING CARRIAGE

BACKGROUND OF THE INVENTION

In conventional logging operations, the initial transportation of a felled tree from the location where it is cut to a location where it can be efficiently transported to a mill is a major logistical problem. Heretofore, temporary roads were constructed throughout the forest area being harvested thereby making the felled trees readily accessible to tractors. Generally, tractors are employed to move each felled tree to a location where it could be transferred to a more convenient mode of transportation. In recent years, however, road building costs and issues of soil compaction have significantly affected the ability to access logs by tractor. This has been particularly true in connection with logging operations carried on federally owned areas. Today there typically is a greater distance between roads, and logs often are hooked to cables or other similar lines and are dragged or skidded by a skidding machine located on one of the roads. Whereas in the past, this technique for skidding logs was used only on very steep terrain that was inaccessible to tractors, it is now being used increasingly on gentle slopes between widely spaced roads.

Log skidding carriages are used in most log skidding operations. The typical log skidding carriage employs a skyline and a drag line which extend through the carriage to a log skidding machine. The log skidding machine is located at a higher elevation than the logs to be skidded, and it can selectively pull in or let out either or both of the lines. The end of the skyline away from the skidding machine is attached to an immovable object or anchor, such as a tree. The end of the drag line away from the skidding machine is attached to the log that is to be skidded.

The typical carriage made according to prior art teachings includes a skyline sheave which rotates along the skyline. Both the skyline and the drag line generally include actuators such as metallic balls or knots near their free ends to control the movement of the carriage along the skyline as explained below.

A log skidding operation commences with the carriage close to the skidding machine. The skyline is unwound by the skidding machine, and is pulled by workers to the immovable object that functions as an anchor. The object may be a tree or tree stump. The skyline is then pulled tight between the skidding machine and the anchor. The drag line then is let out allowing the skyline sheave to roll downhill along the skyline, carrying the carriage and drag line toward the anchor point. The carriage stops moving downhill when it contacts the skyline actuator, after which the skidding machine then unwinds the drag line further and the free end of the drag line is attached to the log to be skidded. The drag line is then pulled in by the skidding machine. Once the actuator on the end of the drag line reaches the carriage, the carriage will be pulled along with the log toward the skidding machine.

This operation will be repeated many times without relocating the skidding machine and without moving the skyline to a new anchor point. Frequently, in fact, all logs within several hundred feet of a single anchor point will be skidded without moving either end of the skyline. In prior art devices, such as that disclosed in U.S. Pat. No. 3,948,398, the free end of the drag line is moved to the log to be skidded by having one or more workers pull the free end of the drag line, while the skidding machine is letting out slack.

Although the log skidding capability of prior art log skidding carriages is generally acceptable, it has been found that frequently it is difficult for the workers to pull the heavy drag line the several hundred feet from the carriage to the log to be skidded. The difficulty of the slack pulling task often is exacerbated by extremely rugged terrain and often wet and slippery ground conditions. Specifically, the typical worker comfortably can exert a pull on the drag line of approximately sixty pounds. However, in many operating conditions, a force substantially in excess of sixty pounds is required. For example, in a skidding operation using a 0.46 pound per foot line on a dry ten percent slope, the worker would have to exert a 120 pound force on the line when he is 600 feet from the skidding machine. This required force would be higher for a heavier weight line, a greater distance from the skidding machine, or different slope or ground moisture characteristics.

Workers required to pull excessive forces are susceptible to injuries varying from pulled muscles to more serious injuries resulting from falls. The probability of injury generally increases in proportion to the force the worker is required to exert. As a result, employers either allocate additional personnel for slack pulling tasks, or periodically reallocate personnel from other ongoing responsibilities to assist in slack pulling. The result of either option is increased cost and decreased efficiency.

A few slack pulling devices are available. However, they are very large devices, weighing 1700 to 2500 pounds. Furthermore, they do not meet the mobility and other needs of logging operations.

Accordingly, it is an object of the present invention to improve the efficiency of log skidding operations by providing a new and improved apparatus capable of being manually operated by a worker.

It is another object of the subject invention to minimize the effort required by a worker for slack pulling aspects of log skidding operations.

It is a further object of the subject invention to provide improved safety for workers in the slack pulling aspects of log skidding operations.

It is still another object of the subject invention to provide an apparatus for slack pulling operations that is lightweight, mobile and well adapted to logging operations.

SUMMARY OF THE INVENTION

The subject invention provides a drive sheave and driving mechanism constructed integrally within a log skidding carriage to pull the slack line released by the skidding machine and to feed that line to the worker. In the preferred embodiment of the subject invention, as explained in detail below, the subject drive sheave is operated by a hydraulic motor, with the fluid to operate the hydraulic motor being stored in one or more accumulators. A valve is provided between the accumulators and the drive sheave, and may be opened to initiate the flow of fluid to the hydraulic motor that actuates the drive sheave. Preferably, this valve is electronically operated to open or close upon receipt of a radio signal from a worker who may be several hundred feet away. Fluid moving from the accumulators through the motor is directed to a reservoir forming a portion of the subject apparatus.

After a sufficient amount of slack is released from the log skidding machine and pulled through the carriage by the drive wheel, the line is affixed to the felled log, and the log is skidded toward the machine in the typical manner. During the skidding operation, rotation of the skyline sheave along the skyline operates a pump which recycles the hydraulic fluid to the accumulators, thereby recharging the accumulators for a subsequent slack pulling operation.

The subject apparatus includes a sequence valve which measures the hydraulic pressure in the accumulators, and which stops flow to the accumulators after they have been fully recharged. Once complete recharge is achieved as measured by the sequence valve, the pump operated by the skyline sheave merely recirculates the hydraulic fluid back into the reservoir.

To insure that the line remains in close contact with the drive sheave for feeding out the slack line, the subject apparatus includes a clutch sheave which is attached to the piston rod of a slave cylinder to force the drag line against the drive sheave. The slave cylinder is activated upon flow of fluid from the accumulators through the radio controlled valve.

DETAILED DESCRIPTION OF THE PREFERRED EMBODIMENT

Figure 1:
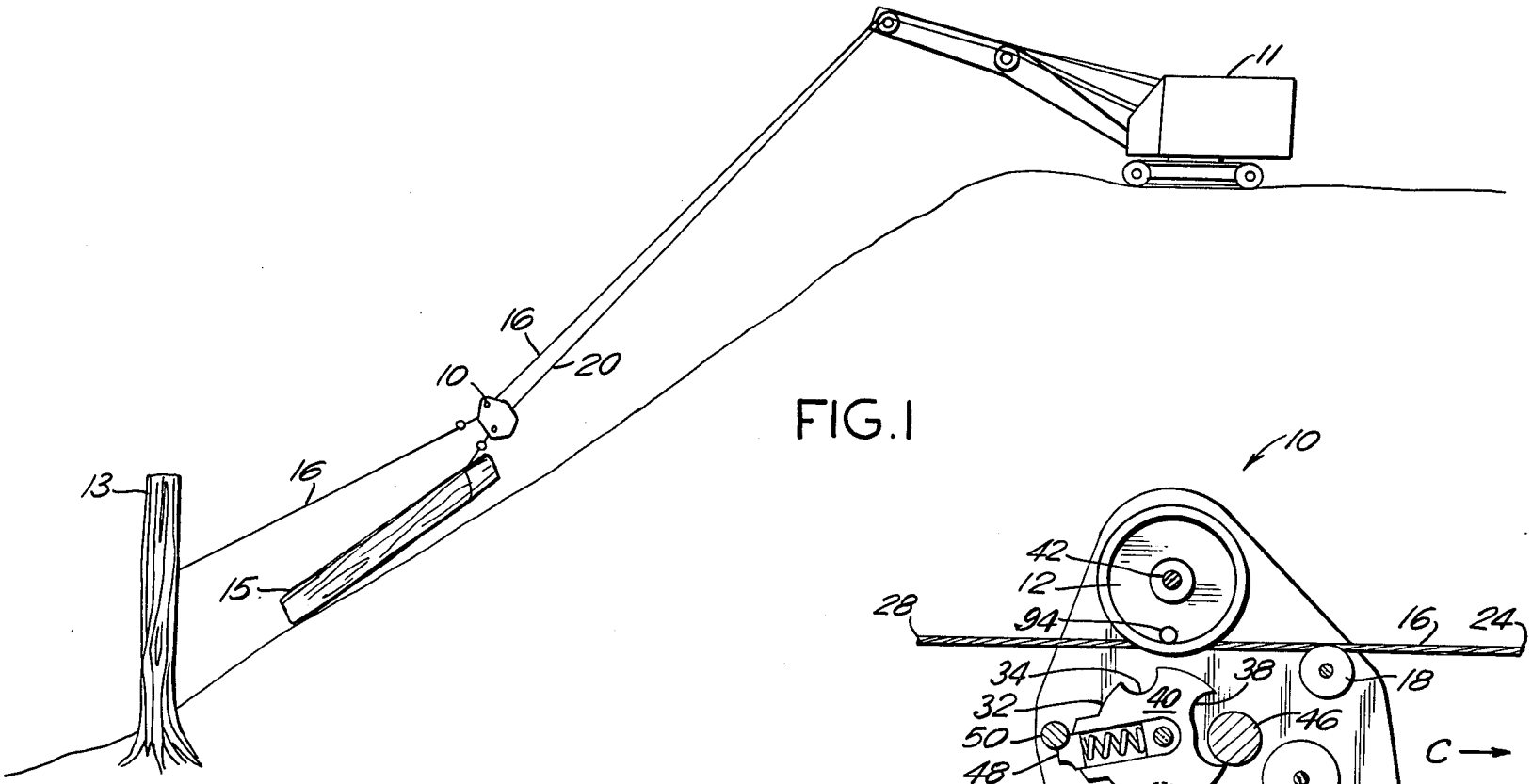
FIG. 1 is a schematic view of the log skidding apparatus of the subject invention in operation.

The slack pulling log skidding carriage 10 of the subject invention is adapted to be suspended from a skyline 16, as shown schematically in FIG. 1. Skyline 16 is pulled tightly between log skidding machine 11 and anchor 13 which is typically a tree or tree stump, however, it could be any other immovable object. Drag line 20 extends through carriage 10 from log skidding machine 11 to log 15. Log skidding machine 11 is operative to pull in or let out skyline 16 and drag line 20 either separately or simultaneously. The subject carriage 10 cooperates with log skidding machine 11 as described below to greatly facilitate the slack pulling aspects of log skidding operations.

Figure 2:
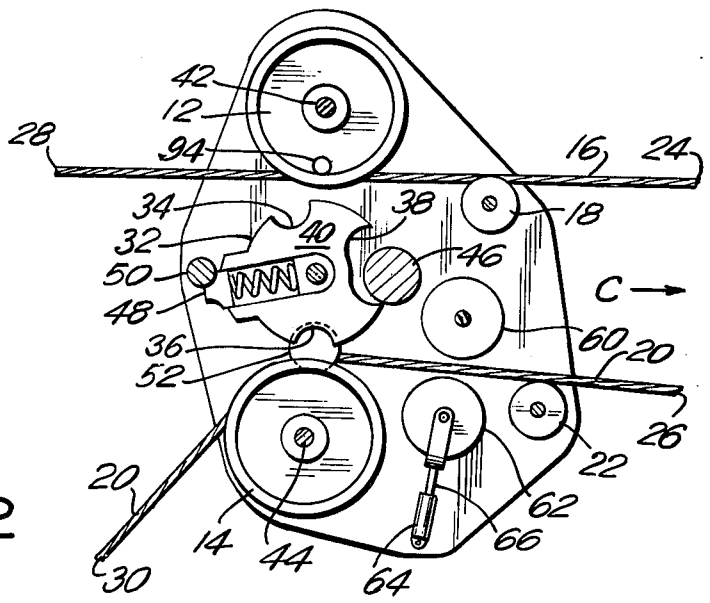
FIG. 2 is a cross sectional side elevational view of the slack pulling carriage of the subject invention, with the slack pulling apparatus disengaged.
Figure 3:
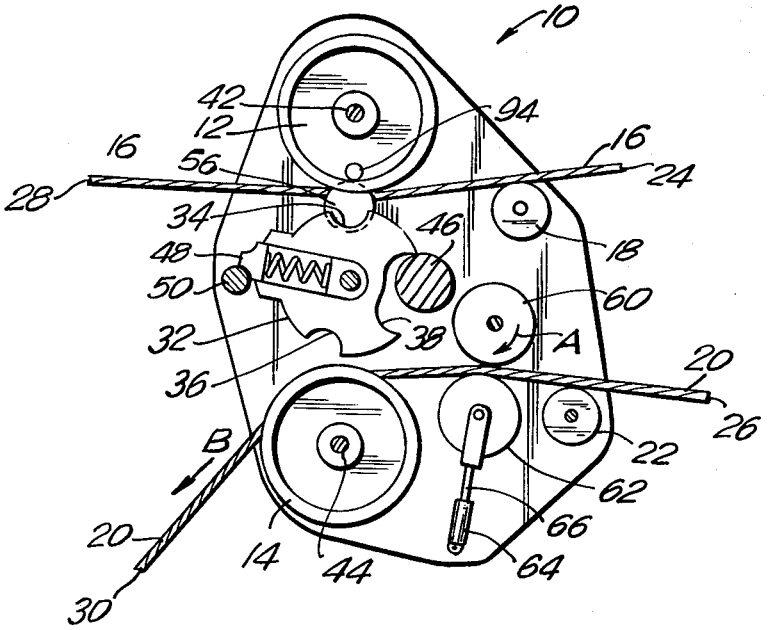
FIG. 3 is a view similar to FIG. 2 with the slack pulling apparatus engaged.

Referring to FIG. 2, the subject slack pulling log carriage 10 includes a skyline sheave 12 and a metallic drag line sheave 14, both of which are preferably made of metal and have a diameter of twelve inches. Skyline sheave 12 and drag line sheave 14 are both mounted in carriage 10 to rotate about their central axes. Skyline 16 extends through carriage 10, and is guided into contact with skyline sheave 12 by an upper guide wheel 18. Similarly, drag line 20 extends through carriage 10 and is guided into contact with drag line sheave 14 by a lower guide wheel 22. As illustrated in FIGS. 2 and 3, the end 24 of skyline 16 and the end 26 of drag line 20 both extend to the log skidding machine (not shown). The opposite end 28 of skyline 16 extends to and is securely attached to the anchor point 13, while the opposite end 30 of drag line 20 extends to and is securely attached to the log 15 to be skidded.

Apparatus 10 further includes a rotatably mounted line lock 32 which is generally circular and has circular cutout portions 34, 36 and 38 disposed about its perimeter, as explained below. Line lock 32 is centrally and rotationally mounted on pin 40 such that pin 40 is colinear with center 42 of skyline sheave 12 and center 44 of drag line sheave 14. The carriage includes a cylindrical stop 46 which cooperates with cutout portion 38 of line lock 32 to limit the rotation of line lock 32 about pin 40. A spring actuated switch 48 cooperates with nub 50 to align line lock 32 into either of its two optional rotational alignments.

In the carriage 10, there is provided a drag line actuator ball 52 that is attached to drag line 30, and is compatible with cutout portion 36 in line lock 32. When drag line actuator ball 52 is seated in cutout portion 36 of line lock 32, the center of drag line actuator ball 52 is colinear with center 42 of skyline sheave 12, the center 44 of drag line sheave 14, and the pin 40 on which line lock 32 is mounted. Also, as shown in FIG. 2, when drag line actuator ball 52 is seated in cutout 36, stop 46 contacts lower point 54 of cutout portion 38 on line lock 32 to prohibit clockwise rotation of line lock 32 beyond the position as illustrated in FIG. 2.

Referring to FIG. 3, skyline actuator ball 56 is attached to skyline 16 between carriage 10 and the anchor point. The location of skyline actuator ball 56 may be changed depending on the location of the log to be skidded. Skyline actuator ball 56 is compatible with cutout portion 34 of line lock 32, whereby when skyline actuator ball 56 is seated in cutout portion 34 of line lock 32, the center of skyline actuator ball 56 is colinear with center 42 of skyline sheave 12, center 44 of drag line sheave 14, and pin 40 on which line lock 32 is mounted. When skyline actuator ball 56 is seated in cutout portion 34 on line lock 32, the upper point 58 of cutout portion 38 on line lock 32 contacts fixed stop 46 to limit the counterclockwise rotation of line lock 32 about pin 40.

As explained in greater detail hereinafter, the movement of drag line actuator ball 52 into contact with line lock 32 causes a clockwise rotational movement of line lock 32 about pin 40 that will operate to release skyline actuator ball 56 from cutout portion 34 thereby resulting in the arrangement of elements as shown in FIG. 2. On the other hand, movement of skyline actuator ball 56 into contact with line lock 32 will cause counterclockwise rotation of line lock 32 about pin 40, thereby releasing drag line actuator ball 52 from cutout portion 36 in line lock 32, and thus resulting in the arrangement of elements as shown in FIG. 3.

As illustrated in both FIGS. 2 and 3, carriage 10 includes a slack drive sheave 60 which is located above drag line 20 and may be made of a plastic urethane material, with a diameter of six inches. A clutch sheave 62 is located below drag line 20, and is attached to slave cylinder 64 by piston rod 66. Preferably, clutch sheave 62 is of a metallic material also of a six inch diameter. As shown in FIG. 2, piston rod 66 is retracted into slave cylinder 64 such that drag line 20 is not in contact with either drive sheave 60 or clutch sheave 62. In the arrangement of FIG. 3 however, piston rod 66 extends from slave cylinder 64 so as to force clutch sheave 62 into contact with drag line 20, and further force drag line 20 into contact with drive sheave 60. Movement of piston rod 66 within slave cylinder 64 is accomplished by hydraulic pressure, as explained in greater detail below.

The carriage 10 includes a hydraulic motor 70 (see FIG. 4) which is attached to drive sheave 60 so as to cause rotation thereof in the direction shown by the arrow A (see FIG. 3) on drive sheave 60. The cooperation of clutch sheave 62 forcing drag line 20 into contact with drive sheave 60, and the simultaneous rotation of drive sheave 60 in the direction indicated by arrow A, feeds the slack drag line through carriage 10 in the direction indicated by arrows B.

Figure 4:
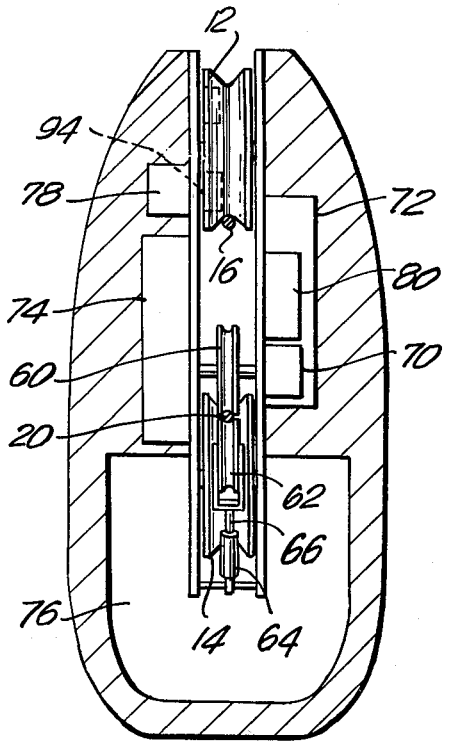
FIG. 4 is a cross sectional front elevational view of the slack pulling carriage of the subject invention.

FIG. 4 illustrates the hydraulic motor 70 cooperatively engaged with drive sheave 60 and causing drive sheave 60 to make one revolution for each 3.6 cubic inches of hydraulic fluid passing through hydraulic motor 70. The entire hydraulic system of the subject invention including the fluid to operate hydraulic motor 70 is stored in accumulators 72 and 74, each of which has a capacity of one and one half gallons. The hydraulic fluid passing through hydraulic motor 70 is stored in four gallon reservoir 76.

Pump 78 is cooperatively engaged with skyline sheave 12. Specifically, gear teeth (not shown) on skyline sheave 12 cooperate with gear teeth (not shown) on the driving member of pump 78. As the carriage 10 is moved toward the skidding machine during a log skidding operation, as described in detail below, each rotation of skyline sheave 12 will cause five rotations of the driving member of gear 94. Each rotation of the driving member of gear 94 in turn will recirculate 0.75 cubic inches of hydraulic fluid from reservoir 76 to accumulators 72 and 74.

The subject apparatus includes within the carriage 10 a radio receiver 80 that cooperates with a standard transmitter (not shown) and with the hydraulic system described below to initiate the flow of hydraulic fluid from accumulators 72 and 74 to hydraulic motor 70 and slave cylinder 64.

Figure 5:
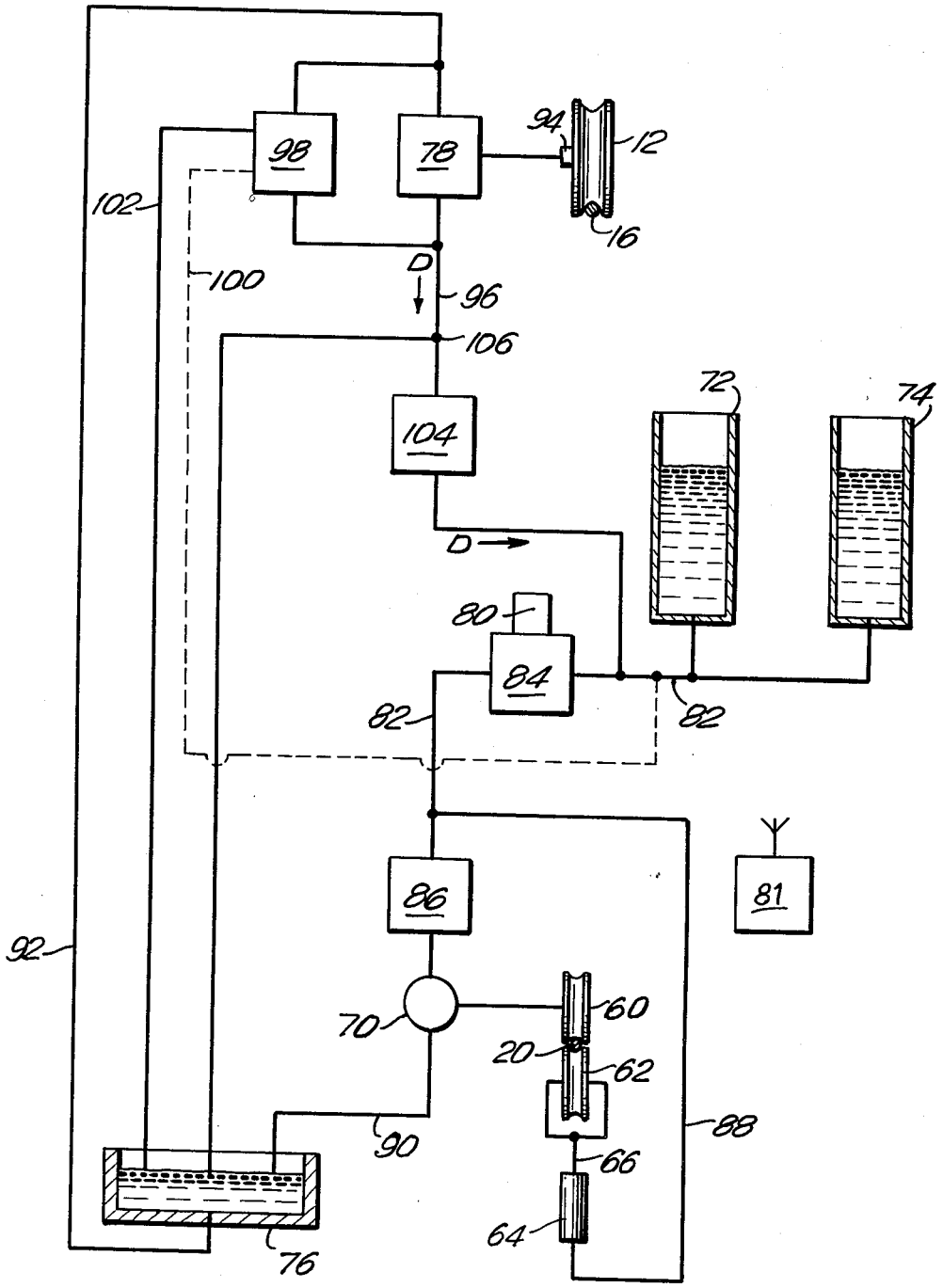
FIG. 5 is a schematic representation of the hydraulic system of the slack pulling apparatus of the subject invention.

FIG. 5 schematically illustrates the hydraulic/electronic system of the subject apparatus. Accumulators 72 and 74 retain the hydraulic fluid prior to a slack pulling operation by the apparatus. Each accumulator 72 and 74 can accommodate one and one-half gallons of hydraulic fluid or 693 cubic inches. Motor feed line 82 is preferably a three-eighth inch, two-wire hydraulic hose extending from accumulators 72 and 74 to hydraulic motor 70. A radio controlled electrical valve 84 is located on motor feed line 82 intermediate hydraulic motor 70 and accumulators 72 and 74. Radio receiver 80 is a commercially available item used in many paging operations, and is powered by a twelve volt nickel cadmium battery. Radio receiver 80 cooperates with radio controlled valve 84 such that upon receipt of a signal from a transmitter 81, the radio controlled valve 84 can be either opened or closed to control the flow of hydraulic fluid from accumulators 72 and 74 to hydraulic motor 70. The transmitter used in conjunction with radio controlled valve 80 may be a commercially available MX Motorola Walkie-Talkie that is used in many field operations, and that includes a separate button for transmitting signals to a paging receiver such as receiver 80.

The flow control valve 86 is located intermediate radio controlled valve 84 and hydraulic motor 70 to insure a constant flow of hydraulic fluid to hydraulic motor 70. Slave cylinder line 88 extends to slave cylinder 64 from a point on motor feed line 82 intermediate radio controlled valve 84 and flow controlled valve 86. When hydraulic fluid flows through motor feed line 82 toward hydraulic motor 70, hydraulic pressure is applied to slave cylinder 64 to force piston rod 66 and clutch sheave 62 toward drive sheave 60. The movement of clutch sheave 62 toward drive sheave 60 forces drag line 20 into contact with both drive sheave 60 and clutch sheave 62. Hydraulic motor 70 causes drive sheave 60 to make one revolution for every 3.6 cubic inches of hydraulic fluid passing through hydraulic motor 70. The rotation of drive sheave 60 while in contact with drag line 20 advances drag line 20 through carriage 10. Slack sheave 62 freely rotates on piston rod 66 thereby facilitating the movement of drag line 20 through carriage 10.

A discharge line 90 extends from hydraulic motor 70 to reservoir 76. Thus, hydraulic fluid passing through hydraulic motor 70 is carried by discharge line 90 to reservoir 76. As mentioned above, reservoir 76 has a capacity of four gallons which is greater than the combined capacity of accumulators 72 and 74.

A recirculation line 92 extends from reservoir 76 to recharge pump 78 that includes driving gear 94 which cooperates with gear teeth (not shown) on skyline sheave 12. As shown in FIG. 2, drag line actuator ball 52 is attached to drag line 20. After the drag line 20 has been pulled in to a sufficient extent by the skidding machine, drag line actuator ball 52 will engage cutout portion 36 on line lock 32 such that subsequent in-hauling of drag line 20 will also pull carriage 10 toward the skidding machine in the direction shown by arrow C, in FIG. 2. The weight of the log 15 and of the carriage 10 will cause skyline sheave 12 to rest on and roll along skyline 16 as carriage 10 and the log advance simultaneously toward the skidding machine.

Returning to FIG. 5, the rolling rotational movement of skyline sheave 12 along skyline 16 as the carriage 10 is advanced toward the skidding machine causes the gear teeth on skyline sheave 12 to interact with gear 94 and thereby to drive recharge pump 78. The gear teeth on skyline sheave 12 and on gear 94 are arranged such that one rotation of skyline sheave 12 results in five complete rotations in gear 94. In turn, each rotation of gear 94 resulting from the advance of carriage 10 toward the skidding machine causes 0.75 cubic inches of hydraulic fluid to be pumped from reservoir 76 through recirculation line 92. This hydraulic fluid is then advanced through recharge line 96 to accumulators 72 and 74.

Sequence valve 98 is connected to each side of recharge pump 78, such that during the time that accumulators 72 and 74 are being recharged, the hydraulic fluid passes from recirculation line 92 through sequence valve 98 and into recharge line 96. Pressure line 100 extends from sequence valve 98 to accumulators 72 and 74 to measure the hydraulic pressure in accumulators 72 and 74. Specifically, as accumulators 72 and 74 are recharged, the hydraulic pressure therein increases. When accumulators 72 and 74 are recharged to their maximum capacity of one and one-half gallons, the hydraulic pressure therein will be approximately 2,000 pounds per square inch. Sequence valve 98 is set to divert the flow of hydraulic fluid from accumulators 72 and 74 once the hydraulic pressure therein equals 2,000 pounds per square inch. When this pressure is achieved, recharge pump 78 will continue to operate; however, the hydraulic fluid will be diverted back to reservoir 76 through diversion line 102.

As also illustrated in FIG. 5, check valve 104 is located on recharge line 96 intermediate recharge pump 78 and accumulators 72 and 74. The check valve 104 is operative to insure that the hydraulic fluid flows through recharge line 96 only in the direction shown by the arrows D in FIG. 5. Thus, after the recharging operation has ceased, and particularly when a slack feeding operation is in progress, the hydraulic fluid is not able to travel through recharge line 96 toward recharge pump 78.

Relief valve 106 is connected to recharge line 96 intermediate recharge pump 78 and check valve 104. The relief valve 106 is essentially a fail-safe device that can direct fluid to reservoir 76 if check valve 104 closes while recharge pump 78 is still operating.

Returning to FIG. 1, at the beginning of a skidding operation, carriage 10 would be located in close proximity to skidding machine 11. Skyline 16 and drag line 20 both extend through carriage 10, and drag line actuator ball 52 is engaged in carriage 10, as described above. Skidding machine 11 unwinds skyline 16 and the workers then attach free end 17 of skyline 16 to anchor 13. Skidding machine 11 then pulls skyline 16 taut, and releases slack on drag line 20. The force of gravity acting upon carriage 10 will cause the skyline sheave 12 to roll downwardly along skyline 16 thereby moving carriage 10 toward anchor point 13. The interaction of drag line actuator ball 52 with carriage 10 will cause drag line 20 to move with carriage 10 downhill toward anchor point 13. As carriage 10 approaches, the anchor 13, skyline actuator ball 56 engages carriage 10 in the manner described above, thereby stopping the downward movement of carriage 10 and simultaneously disengaging drag line actuator ball 52 from carriage 10.

Next, workers would attach the free end 19 of drag line 20 to the log 15 to be skidded. However, as explained above, the log 15 to be skidded frequently will be several hundred feet away from carriage 10. Therefore, log skidding machine 11 will unwind drag line 20, and a worker will pull the free end 19 of the drag line through carriage 10 toward the log 15 to be skidded. To facilitate this slack pulling, the worker transmits the appropriate electrical signal from his radio transmitter. The message transmitted thereby will be received by radio receiver 80 within carriage 10 which, in turn, will open radio controlled valve 84, as shown in FIG. 5. Hydraulic fluid will then pass through motor feed line 82 and through slave cylinder line 88. As a result, slave cylinder 64 will push piston rod 66 and clutch sheave 62 into contact with drag line 20, thereby forcing drag line 20 into contact with drive wheel 60. Simultaneously, hydraulic fluid will pass from accumulators 72 and 74 through hydraulic drive line 82 to operate the hydraulic motor 70. Drive wheel 60 will be turned by hydraulic motor 70 advancing the drag line 20 through carriage 10. Thus, returning to FIG. 1, as log skidding machine 11 produces slack in drag line 20, drive wheel 60 will advance that slack drag line 20 through carriage 10. As a result, the distance over which slack has to be pulled will be greatly reduced, thereby significantly reducing the force that must be exerted by the worker in pulling the slack drag line to log 15.

After free end 19 of drag line 20 is firmly attached to log 15, skidding machine 11 commences its in-haul of drag line 20. The initial phase of this in-haul will advance log 15 toward carriage 10. As log 15 approaches carriage 10 however, drag line actuator ball 52 will engage carriage 10 in the manner described above, thereby releasing skyline actuator ball 56. Subsequent in-haul of drag line 20 will move both log 15 and carriage 10 toward log skidding machine 11. Movement of carriage 10 toward log skidding machine 11 will cause skyline sheave 12 to roll along skyline 16. This rotational movement of skyline sheave 12 will drive recharge pump 78 in the manner described above thereby recharging accumulators 72 and 74. In many operations, accumulators 72 and 74 will be completely recharged before carriage 10 reaches log skidding machine 11. As explained above, and as shown schematically in FIG. 5, upon complete recharge of accumulators 72 and 74 sequence valve 98 will redirect all pumped hydraulic fluid back to reservoir 76.

After removal of log 15 from free end 19 of drag line 20, log skidding machine 11 unwinds drag line 20 so that the force of gravity on carriage 10 urges carriage 10 to roll down skyline 16 in the manner described above. Accumulators 72 and 74 would be completely recharged prior to the descent of carriage 10. As a result, workers immediately could proceed to move the free end 19 of drag line 20 to the next log to be skidded.

In summary, a new and improved log skidding carriage is provided with a slack feeding apparatus that greatly facilitates the movement of the drag line from the carriage to the log to be skidded. The slack feeding apparatus is operated hydraulically. The carriage includes at least one accumulator that stores hydraulic fluid prior to the slack feeding operation. A radio controlled valve allows the hydraulic fluid to force the drag line into contact with a drive wheel and to operate a hydraulic motor that rotates the drive wheel thereby feeding slack through the carriage. Hydraulic fluid that passes through the hydraulic motor is stored in a reservoir. The reservoir is connected to a pump which in turn is connected to a sheave in the carriage. The cooperation between the sheave and the pump enables the accumulators to be recharged as the log is being skidded to the log skidding machine. A sequence valve, a relief valve and a check valve are provided in the log skidding carriage to insure the proper operation of the apparatus.

While the preferred embodiment of the subject invention has been described and illustrated, it is obvious that various changes and modifications can be made therein without departing from the spirit of the present invention. For example, the carriage can be adapted to recharge the accumulators during the downward movement of carriage along the skyline. Additionally the line lock, actuator balls and related components can be replaced by simple knots near the ends of the skyline and drag line that would limit the movement of the carriage away from the skidding machine. Accordingly, it is emphasized that the present invention should be limited only by the scope of the appended claims.

What is claimed is:

1. In a log carriage for use with a log skidding machine, said carriage adapted to be suspended from a skyline and including a rigid housing defining the outer surface of said carriage, a skyline sheave rotatably mounted in said housing with the perimeter of said skyline sheave adapted to be mounted on and rollable along a skyline, a drag line sheave rotatably mounted in said housing with the perimeter of said drag line sheave adapted to support a drag line, and a line lock for automatically locking said carriage alternately to said skyline and said drag line, the improvement comprising:

a slack-pulling sheave rotatably mounted in said housing;

a hydraulic motor cooperatively engaged with said slack-pulling sheave for rotating said slack-pulling sheave about its centroid;

at least one accumulator for storing and dispensing hydraulic fluid;

a feed tube connecting said at least one accumulator to said hydraulic motor for directing hydraulic fluid from said at least one accumulator to said hydraulic motor for driving said hydraulic motor;

an accumulator valve in communication with said feed tube for selectively starting or stopping the flow of hydraulic fluid from said at least one accumulator to said hydraulic motor;

a hydraulic clutch fixedly attached to said housing and being operative to force said drag line to frictional engagement with said slack-pulling sheave;

a clutch tube extending from said hydraulic clutch to a point on said feed tube intermediate said accumulator valve and said hydraulic motor, said clutch tube directing hydraulic fluid from said at least one accumulator to said hydraulic clutch;

a reservoir in communication with said hydraulic motor for receiving hydraulic fluid from said hydraulic motor;

a recharge tube extending from said reservoir to a point on said feed tube intermediate said accumulator valve and said at least one accumulator; and a recharge pump in communication with said recharge tube and cooperatively engaged with said skyline sheave, whereby rollable movement of said skyline sheave along said skyline causes rotation of said skyline sheave and whereby rotation of said skyline sheave operates said recharge pump to urge the hydraulic fluid from said reservoir to said at least one accumulator thereby recharging said at least one accumulator.

2. A slack-pulling log skidding carriage as in claim 1 wherein said accumulator valve is a radio controlled valve and wherein said slack-pulling log skidding carriage further comprises a radio receiver and a radio transmitter, said radio controlled valve being adapted to operate when said radio receiver receives a signal from said radio transmitter.

3. A slack-pulling log skidding carriage as in claim 1 wherein said hydraulic clutch comprises a slave cylinder and a piston rod, said piston rod having first and second ends, the first end of said piston rod being slidably engaged with said slave cylinder, and a clutch sheave being rotatably mounted on the second end of said piston rod, said slave cylinder being operable to move said clutch sheave into engagement with said drag line and to move said drag line into frictional engagement with said slack-pulling sheave.

4. A slack-pulling log skidding carriage as in claim 1 further comprising a sequence valve in communication with said recharge pump, said reservoir and said at least one accumulator, said sequence valve being adapted to detect complete recharge of said at least one accumulator whereby upon complete recharge of said at least one accumultor said sequence valve directs excess hydraulic fluid from said recharge pump to said reservoir.

5. A slack-pulling log skidding carriage as in claim 1 further comprising a check valve in communication with said recharge tube intermediate said recharge pump and said at least one accumulator, whereby said check valve prohibits the flow of hydraulic fluid from said at least one accumulator to said recharge pump.

6. A slack-pulling log skidding carriage as in claim 5 further comprising a relief valve in communication with said reservoir and a point on said recharge tube intermediate said recharge pump and said check valve, said relief valve being operative to direct hydraulic fluid to said reservoir when said check valve is closed, thereby avoiding a back up of hydraulic fluid into said recharge pump.

7. A slack-pulling log skidding carriage as in claim 1 further comprising a flow control valve in communication with said feed tube and disposed intermediate said hydraulic pump and the connection of said clutch tube to said feed tube, said flow control valve ensuring a constant rate of flow of hydraulic fluid to said hydraulic pump.

* * * * *